US011452340B2

(12) United States Patent
Santos et al.

(10) Patent No.: US 11,452,340 B2
(45) Date of Patent: Sep. 27, 2022

(54) BRAIDED ARTICLE WITH REINFORCED STITCH

(71) Applicant: Under Armour, Inc., Baltimore, MD (US)

(72) Inventors: Craig Santos, Portland, OR (US); Carman Zhu, Dongguan (CN); James Huang, Dongguan (CN)

(73) Assignee: Under Armour, Inc., Baltimore, MD (US)

( * ) Notice: Subject to any disclaimer, the term of this patent is extended or adjusted under 35 U.S.C. 154(b) by 172 days.

(21) Appl. No.: 16/556,486

(22) Filed: Aug. 30, 2019

(65) Prior Publication Data

US 2021/0059357 A1 Mar. 4, 2021

(51) Int. Cl.

| | |
|---|---|
| ***A43B 23/02*** | (2006.01) |
| ***D04C 1/06*** | (2006.01) |
| ***A43B 1/04*** | (2022.01) |
| ***A43B 9/02*** | (2006.01) |
| ***A43C 11/00*** | (2006.01) |

(52) U.S. Cl.

CPC ..... *A43B 23/0275* (2013.01); *A43B 1/04* (2013.01); *A43B 9/02* (2013.01); *A43B 23/025* (2013.01); *A43B 23/0235* (2013.01); *D04C 1/06* (2013.01); *A43C 11/004* (2013.01); *D10B 2501/043* (2013.01)

(58) Field of Classification Search

CPC ..... A43C 11/004; A43C 5/00; D04C 1/06; D10B 2501/043; A43B 9/00; A43B 23/088; A43B 1/04; D05B 93/00

See application file for complete search history.

(56) References Cited

U.S. PATENT DOCUMENTS

| | | | | | |
|---|---|---|---|---|---|
| 376,372 | A | | 1/1888 | Dodge et al. | |
| 1,214,563 | A | * | 2/1917 | McNeil | D05B 93/00 112/435 |
| 1,407,661 | A | * | 2/1922 | Kenton | A43B 23/025 36/45 |
| 1,578,195 | A | * | 3/1926 | Fitzgerald | A43D 11/02 112/412 |
| 2,082,309 | A | * | 6/1937 | Turiansky | A43B 23/025 36/3 A |
| 2,197,134 | A | * | 4/1940 | Rubinstein | A41B 5/00 2/131 |
| 2,244,030 | A | * | 6/1941 | Teehan | A43B 23/024 36/54 |
| 2,259,944 | A | * | 10/1941 | Vamos | A43C 11/006 36/51 |

(Continued)

*Primary Examiner* — Jocelyn Bravo

(74) *Attorney, Agent, or Firm* — Maginot, Moore & Beck LLP

(57) ABSTRACT

In one embodiment, an article of footwear including an upper is described. The upper includes a braid body and at least one component. The braid body includes at least one braided layer. A reinforcement element is attached to the braid body along a connection area using a connecting stitch. The component is attached to the braid body at the connection area using a zigzag stitch including a thread that passes through the component at a first location and passes through the reinforcement element and the braid body at a second location. The second location extends beyond the connecting stitch attaching the reinforcement element to the braid body.

20 Claims, 8 Drawing Sheets

(56) References Cited

U.S. PATENT DOCUMENTS

| | | | | |
|---|---|---|---|---|
| 4,369,589 | A * | 1/1983 | Summey | A43B 15/00 36/130 |
| 4,726,128 | A * | 2/1988 | Lin | A43B 3/0031 36/132 |
| 4,783,909 | A * | 11/1988 | Van Doren | A43B 3/102 36/68 |
| 5,257,571 | A | 11/1993 | Richardson | |
| 6,237,251 | B1 * | 5/2001 | Litchfield | A43B 1/0072 36/114 |
| 6,401,364 | B1 * | 6/2002 | Burt | A43B 1/00 36/3 A |
| 7,908,956 | B2 | 3/2011 | Dow et al. | |
| 2008/0250668 | A1 * | 10/2008 | Marvin | A43B 23/0205 36/54 |
| 2011/0107620 | A1 * | 5/2011 | Bell | A43B 23/025 36/83 |
| 2018/0049509 | A1 * | 2/2018 | Zwick | A43B 23/0295 |
| 2018/0343961 | A1 * | 12/2018 | Bruce | A43B 5/02 |
| 2020/0068995 | A1 * | 3/2020 | Juckelandt | A43B 1/10 |

* cited by examiner

BRAIDED ARTICLE WITH REINFORCED STITCH

BACKGROUND

The present embodiments relate generally to articles of footwear, and in particular to articles of footwear that incorporate braided components.

Typical athletic shoes include two major components, an upper that provides the enclosure for receiving the foot, and a sole secured to the upper. The upper may include laces, hook-and-loop fasteners or other devices to provide adjustable securement of the article to the foot of a user. Some articles of footwear may incorporate midsole components to provide comfort and support to the foot of a user. Articles of footwear may also include ground-engaging members to provide traction and grip.

SUMMARY

In one embodiment, an article of footwear including an upper is provided. The upper includes a braid body and at least one component. The braid body comprises at least one braided layer. A reinforcement element is attached to the braid body along a connection area using a connecting stitch. The component is attached to the braid body at the connection area using a zigzag stitch comprising a thread that passes through the component at a first location and passes through the reinforcement element and the braid body at a second location. The second location extends beyond the connecting stitch attaching the reinforcement element to the braid body.

In another embodiment, an article of footwear including a braided upper is provided. The braided upper includes a throat area and a heel area. The article of footwear includes a component including a lace eyelet element and a heel cushioning element. A reinforcement element is attached to the braided upper along a connection area using two rows of approximately parallel stitches. The connection area includes the throat area and the heel area. The component is attached to the braided upper at the connection area using a zigzag stitch comprising a thread that passes through the component at a first location and passes through the reinforcement element and the braided upper at a second location. The second location extends beyond the two rows of approximately parallel stitches attaching the reinforcement element to the braided upper.

In another embodiment, a method of making an upper for an article of footwear is provided. The method includes forming a braid body comprising at least one braided layer. The method also includes forming a component configured to attach to the braid body. The component and the braid body comprise the upper. The method includes stitching a reinforcement element to the braid body along a connection area using a connecting stitch. The method further includes stitching the component to the braid body at the connection area using a zigzag stitch comprising a thread that passes through the component at a first location and passes through the reinforcement element and the braid body at a second location. The second location extends beyond the connecting stitch joining the reinforcement element to the braid body.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
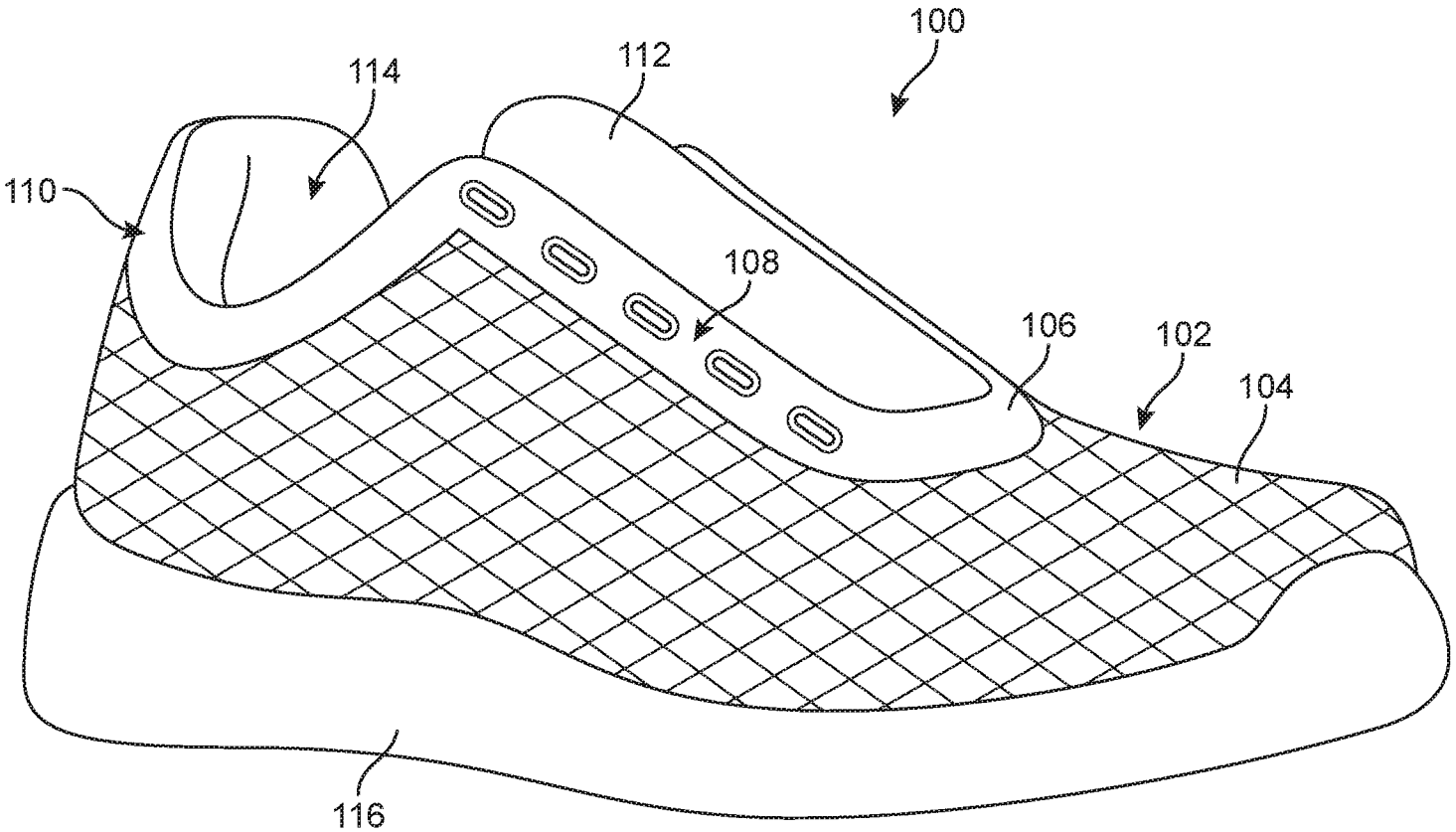
FIG. 1 is a schematic view of an example embodiment of a braided article of footwear.

In the following detailed description, reference is made to the accompanying figures that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicates that the embodiment described may include a particular feature, structure, or characteristic that may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, the term "article" refers broadly to articles of footwear, articles of apparel (e.g., clothing), as well as accessories and/or equipment. Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

For purposes of general reference, an article of footwear and associated components such as a last, may be divided into three regions: a forefoot region, a midfoot region, and a heel region. The forefoot region may be generally associated with the toes and joints connecting the metatarsals with the phalanges. The midfoot region may be generally associated with the arch of a foot, including the instep. Likewise, the heel region or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from the forefoot region to the heel region of the article of footwear. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between a medial side and a lateral side of an article of footwear or last, with the lateral side of the article of footwear being the surface that faces away from the other foot, and the medial side being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The term "side," as used in this specification and in the claims, refers to any portion of a component facing generally in a lateral, medial, forward, or rearward direction, as opposed to an upward or downward direction. The term "lateral side" refers to any component facing in general toward the lateral direction. The term "medial side" refers to any component facing in general toward the medial direction.

FIG. 1 depicts an example embodiment of a braided article of footwear 100. In this embodiment, article of footwear 100 includes a braided upper 102 formed by a braid body 104 and at least one component 106 attached to braid body 104. Braid body 104 includes at least one braided layer, which may be formed using a braiding machine.

For example, a braiding machine may include a plurality of spools that include strands or threads. The spools pass by one another along a track such that the plurality of strands intertwine and twist with one another. This twisting and intermeshing of the plurality of strands forms a braided structure, including, for example, one or more braided layers of braid body 104. An example of a braiding machine is described in Richardson, U.S. Pat. No. 5,257,571, granted Nov. 2, 1993, entitled "Maypole Braider Having a Three Under and Three Over Braiding Path," the entirety of which is hereby incorporated by reference. Additionally, another example of a braiding machine is described in Dow et al., U.S. Pat. No. 7,908,956, granted Mar. 22, 2011, entitled "Machine for Alternating Tubular and Flat Braid Sections," the entirety of which is hereby incorporated by reference. An example of a braiding machine that includes a former that is passed through the braiding machine is described in Dodge et al., U.S. Pat. No. 376,372, granted Jan. 10, 1888, entitled "Manufacture of Woolen Boots," the entirety of which is hereby incorporated by reference.

In an example embodiment, component 106 may include one or more elements that are formed separately from braid body 104 and are configured to be joined or attached to braid body 104 to form braided upper 102. In this embodiment, component 106 includes a lace eyelet element 108 and a heel cushioning element 110. Lace eyelet element 108 is configured to attach to braid body 104 along a connection area that includes a throat area of braid body 104. Lace eyelet element 108 includes a plurality of eyelets that receive a lace to fasten and/or tighten article of footwear 100 around a foot of a wearer.

Heel cushioning element 110 is configured to attach to braid body 104 along a connection area that includes a heel area of braid body 104. Heel cushioning element 110 includes foam padding or other cushioning material that is particularly placed to align with an ankle of a foot of wearer. Additionally, heel cushioning element 110 may be joined together in the heel region to form a heel cup for article of footwear 100.

Additionally, a tongue 112 is attached to braided upper 102 in a midfoot region of article of footwear 100 and is configured to cover an instep of a foot of a wearer. Braided upper 102 further includes a throat opening 114 configured to receive a foot of a wearer within article of footwear 100.

In one embodiment, article of footwear 100 also includes a sole assembly 116. Sole assembly 116 attaches to a bottom of braided upper 102 and is configured to extend beneath a foot of a wearer when article of footwear 100 is worn. Sole assembly 116 may include one or more of an insole, midsole, and/or outsole. For example, as shown in FIG. 1, sole assembly 116 includes an outsole configured to engage a ground surface when article of footwear is worn. A sole assembly used with the example embodiments described herein may incorporate an insole, a midsole, a plate, an outsole, and/or other elements.

In an example embodiment, braid body 104 includes at least one braded layer formed by a plurality of strands using a braiding machine. In various embodiments, the plurality of strands forming the braided layer of braid body 104 may be formed of different materials. The properties that a particular strand will impart to an area of a braided structure (e.g., a braided layer of braid body 104) depend on the materials that form the various filaments and fibers within the strands. For example, the filaments may be formed of cotton. Cotton may provide a soft hand, natural aesthetics as well as biodegradability. Other embodiments may include elastane or stretch polyester. In still further embodiments, nylon may be incorporated. Nylon is a durable, abrasion-resistant material with relatively high strength that may be incorporated into areas of an article of footwear that are more likely to be exposed to high stress or scraping than other areas. Polyester may be incorporated due to its hydrophobic nature. For example, a waterproof or water-resistant article may incorporate polyester. Additionally, various materials may be utilized for sweat removal or wicking. The materials chosen may also include properties that permit the material to melt or bond to various components. For example, the materials may include thermoplastic or thermoset materials as well as other heat-activated materials.

Additionally, other materials may be utilized for various material properties. In addition to material, other aspects of the strand may be altered to affect the properties of the braided structure. For example, a strand may include monofilament or multifilament thread. The strand may also include separate filaments that are formed of different materials, such as bicomponent strands. As shown in the figures, a braided layer of braid body 104 may be formed of an abrasion-resistant material such as nylon. The abrasion-resistant material may provide a durable surface to a wearer of article of footwear 100 incorporating the braided layer of braid body 104.

In an example embodiment, component 106 is formed separately from braid body 104 and is joined or attached to braid body 104 along a connection area using the techniques described herein to form braided upper 102 of article of footwear 100. In this embodiment, component 106 includes lace eyelet element 108 and heel cushioning element 110 that are formed together to be a substantially continuous piece, which may be sewn or joined together at the heel area of article of footwear 100. In other embodiments, lace eyelet element 108 and heel cushioning element 110 may each be formed separately and individually joined or attached to braid body 104. In addition, various other components may be attached to braid body 104 at different locations. For example, a toe cap may be attached to the braided layer of braid body 104. Additionally, it should be recognized that support stiffeners or additional support members may be placed in various positions along the braided layer of braid body 104.

Figure 2:
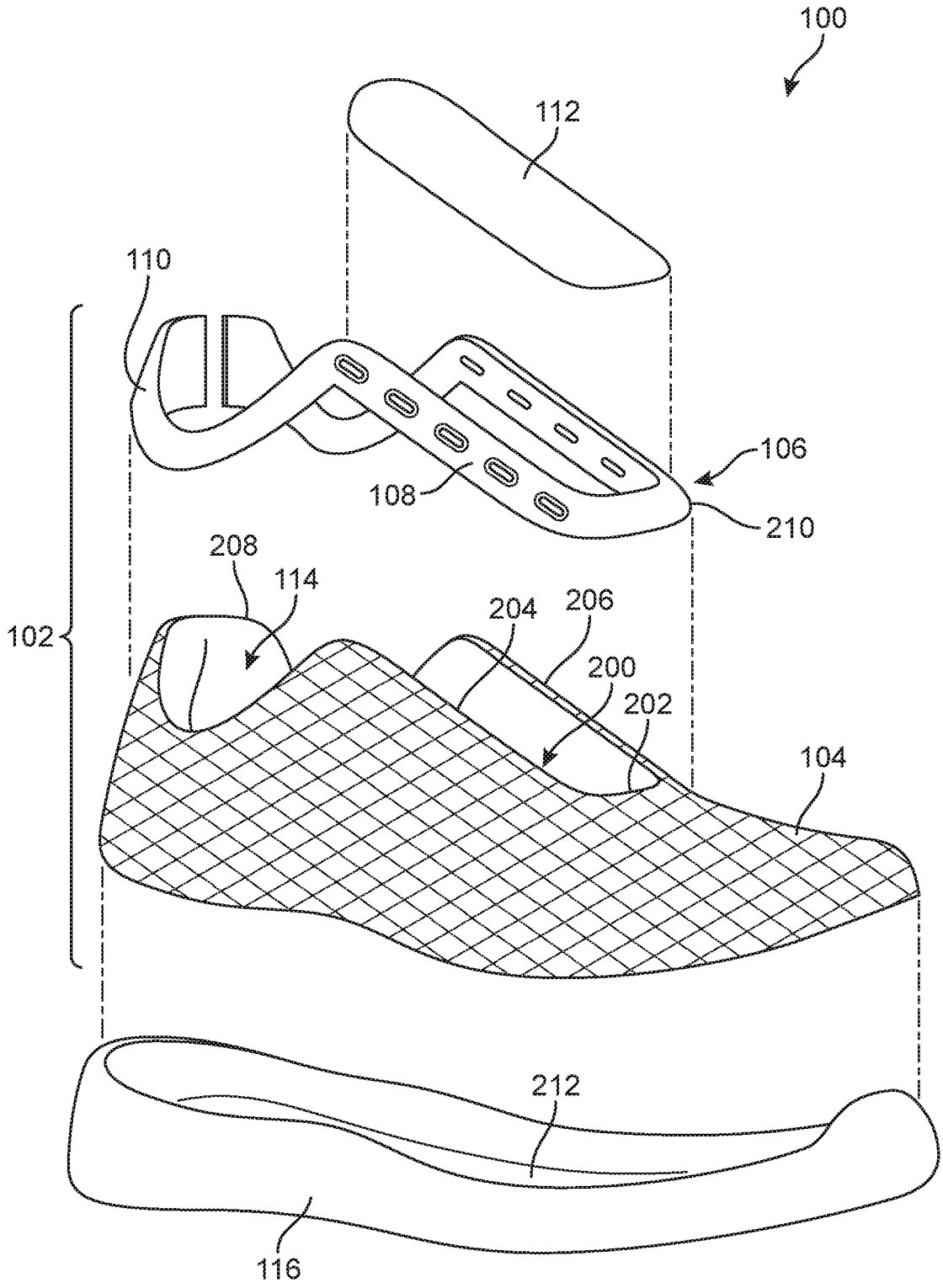
FIG. 2 is an exploded view of an example embodiment of a braided article of footwear.

Referring now to FIG. 2, an exploded view of article of footwear 100 is shown. As shown in this embodiment, braided upper 102 of article of footwear 100 includes braid body 104 and at least one component 106, including lace eyelet element 108 and heel cushioning element 110. As described above, component 106 is configured to be joined or attached to braid body 104 along a connection area 200. In an example embodiment, connection area 200 is a portion of the braided layer of braid body 104 at which component 106 will be attached to braid body 104. In an example embodiment according to the techniques described herein, component 106 is attached to braid body 104 along connection area 200 by stitching using a thread, yarn, strand, or other similar material to join component 106 and braid body 104.

In this embodiment, connection area 200 of braid body 104 includes one or more portions of a throat area and/or a heel area of braided upper 102. For example, as shown in FIG. 2, portions of connection area 200 in the throat area of braided upper 102 includes a forward edge 202 disposed between a lateral instep edge 204 and a medial instep edge 206. Additionally, in this embodiment, connection area 200 in the heel area of braided upper 102 includes a collar edge 208 that extends at least partially around throat opening 114.

As will be described in more detail below, component 106 is configured to attach to braid body 104 along connection area 200 by stitching using a zigzag stitch according to the principles of the techniques described herein. In an example embodiment, edges of braid body 104 and edges of component 106 are abutting along connection area 200 (i.e., arranged edge-to-edge). For example, as shown in FIG. 2, an outer edge 210 of component 106 is configured to abut one or more of forward edge 202, lateral instep edge 204, and medial instep edge 206 of braid body 104 in the throat area of braided upper 102. Outer edge 210 of component 106 may also be configured to abut collar edge 208 of braid body 104 that extends at least partially around throat opening 114 in the heel area of braided upper 102. With this abutting relation, braided upper 102 of article of footwear 100 may avoid overlapping or folded areas within the interior of braided upper 102 that can rub or irritate a foot of a wearer.

In one embodiment, braided upper 102 may be attached or secured to sole assembly 116 to form article of footwear 100. For example, as shown in FIG. 2, a bottom portion of braid body 104 of braided upper 102 is configured to align with and attach to an upper surface 212 of sole assembly 116. In some embodiments, the bottom portion of braid body 104 may be attached or joined to upper surface 212 of sole assembly 116 using adhesive and/or welding. For example, in one embodiment, the at least one braided layer of braid body 104 may be adhered to upper surface 212 using adhesives that securely fasten braided upper 102 to sole assembly 116 such that sole assembly 116 may be permanently secured to the braided layer of braid body 104.

It should be understood that components attached to braided upper 102 may be attached or adhered using various techniques. In some embodiments, the components may be sewn or stitched into braid body 104. In other embodiments, the components may be adhered using glue or other adhesive. In still further embodiments, the components may be attached with varying degrees of shear stress resistance. That is, in some embodiments, components may be adhered using a tacky type substance that secures a component in place but is easily removable, while other components may be adhered using adhesives that securely fasten the components to be permanently secured to braid body 104. Additionally, in some embodiments, components may be attached using more than one technique. For example, portions of component 106 may be attached to braid body 104 by stitching according to the example embodiments and may also be at least partially attached or joined using adhesives.

Figure 3:
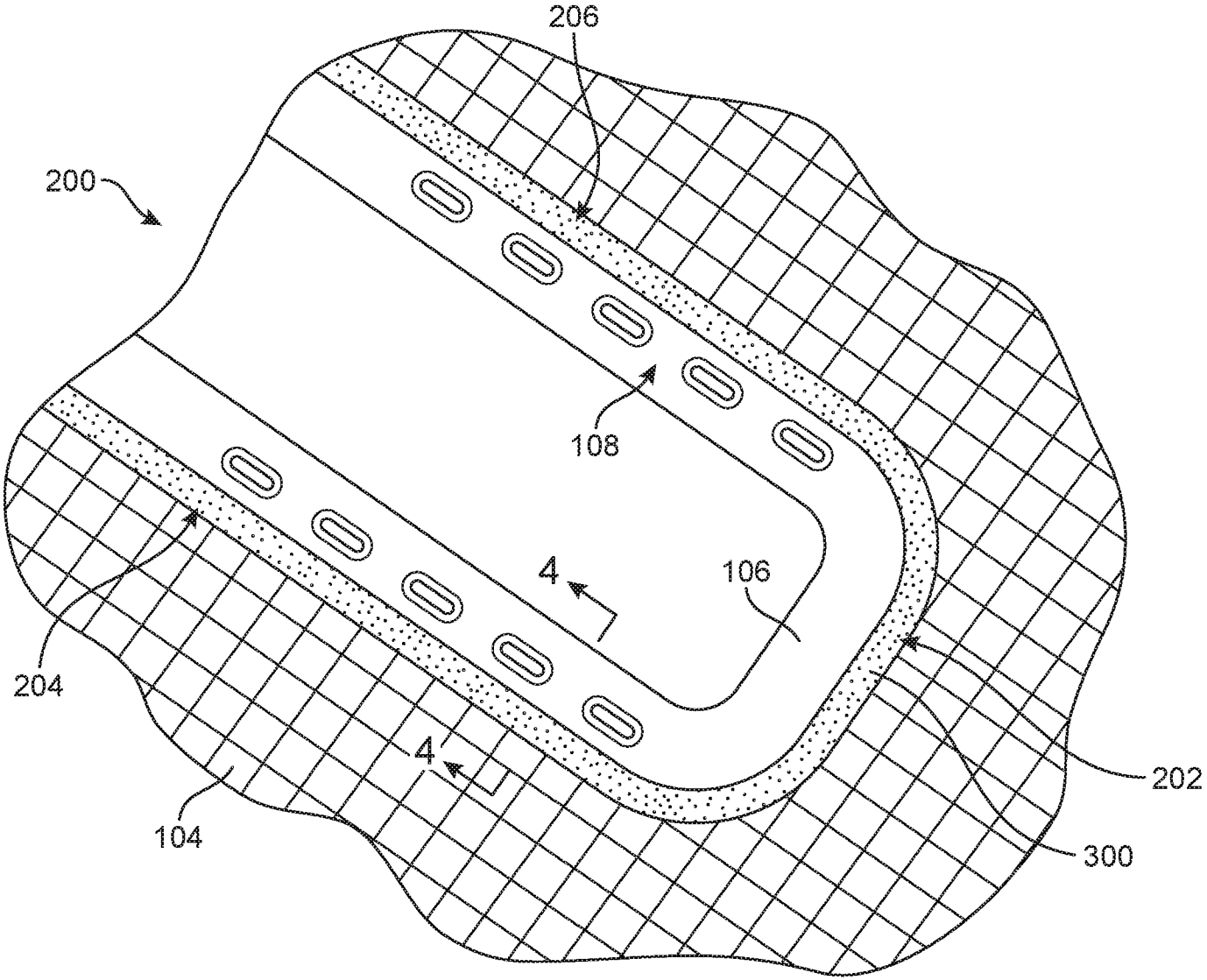
FIG. 3 is an enlarged view of a connection area of a braided upper.

Referring now to FIG. 3, an enlarged view of connection area 200 of braided upper 102 of article of footwear 100 is shown. In this embodiment, component 106, including lace eyelet element 108, is shown joined to braid body 104 along connection area 200. In one embodiment, outer edge 210 of component 106 abuts one or more of forward edge 202, lateral instep edge 204, and medial instep edge 206 of braid body 104 in the throat area of braided upper 102. According to the techniques of the present embodiments, outer edge 210 of component 106 is joined to braid body 104 along connection area 200 using a zigzag stitch that attaches component 106 to braid body 104 along connection area 200, including at forward edge 202, lateral instep edge 204, and medial instep edge 206 of braid body 104 in the throat area of braided upper 102.

In some embodiments, a seam cover element 300 is disposed over a portion of braid body 104 and a portion of component 106 along connection area 200. For example, as shown in FIG. 3, the zigzag stitch connecting component 106 to braid body 104 is located beneath seam cover element 300. That is, a seam disposed along connection area 200 in the throat area of braided upper 102 between abutting portions of component 106 and braid body 104 may be covered with seam cover element 300. With this configuration, seam cover element 300 provides a smooth exterior surface for braided upper 102 of article of footwear 100. Similarly, a seam cover element may be provided to cover the seam where heel cushioning element 210 abuts collar edge 208 of braid body 104 at least partially around throat opening 114 in the heel area of braided upper 102, as well as at any other portions of braided upper 102 where a component is stitched to braid body 104.

Figure 4:
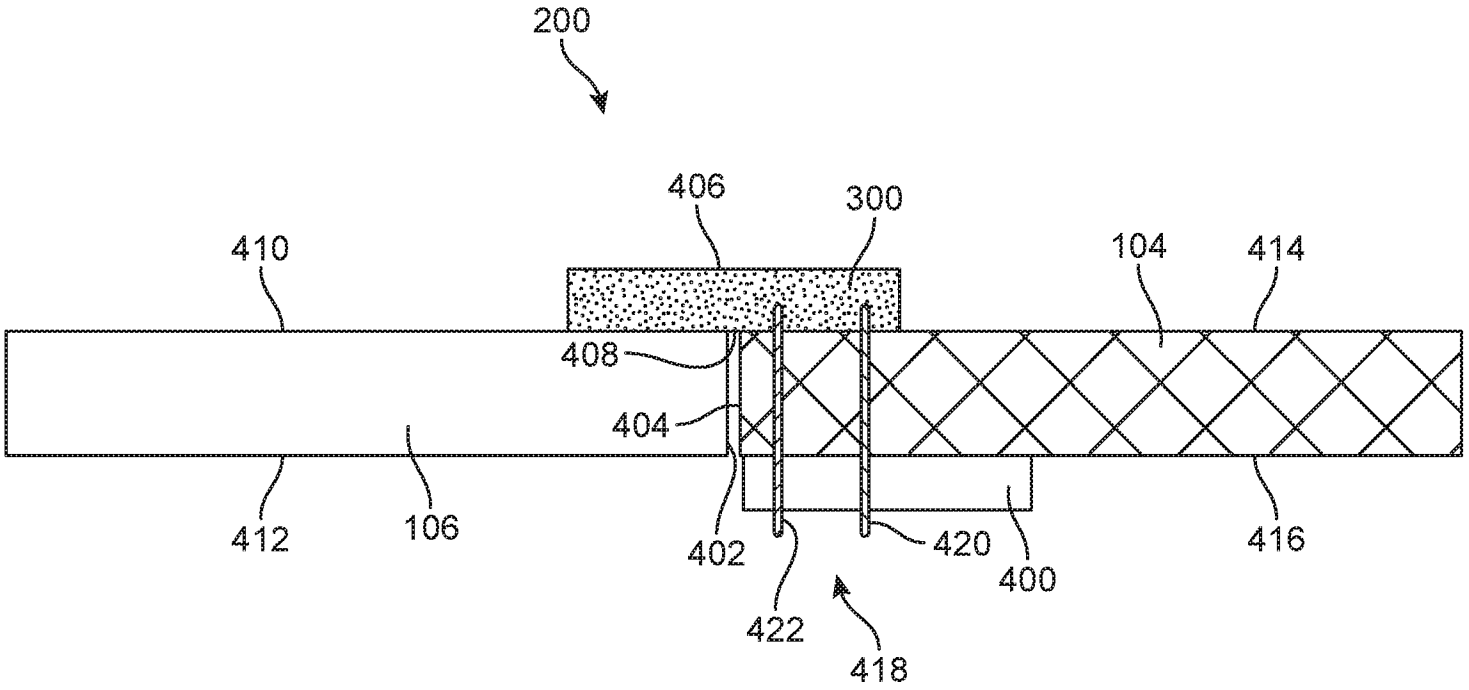
FIG. 4 is a cross-sectional view of the braided upper from FIG. 3 taken along line 4-4.

FIG. 4 is a cross-sectional view of braided upper 102 from FIG. 3 taken along line 4-4. As shown in FIG. 4, a first end 402 of component 106 is abutting a first end 404 of braid body 104 along connection area 200. As described above, seam cover element 300 covers the seam where first end 402 of component 106 abuts with first end 404 of braid body 104 along connection area 200. In this embodiment, seam cover element 300 includes an outer surface 406 that faces outward away from the exterior of braided upper 102 and an opposite inner surface 408 that faces towards component 106 and braid body 104. In an example embodiment, inner surface 408 of seam cover element 300 may include adhesive or other attachment mechanism to secure seam cover element 300 to an outer surface 410 of component 106 and an outer surface 414 of braid body 104.

In some embodiments, a reinforcement element 400 may be attached to braid body 104 along connection area 200. For example, in an example embodiment, reinforcement element 400 is attached to an inner surface 416 of braid body 104 using a connecting stitch 418. In this embodiment, reinforcement element 400 is located on inner surface 416 of braid body 104 adjacent to an inner surface 412 of component 106. In some embodiments, connecting stitch 418 may include two rows of approximately parallel stitches along connection area 200 to join reinforcement element 400 to braid body 104.

As shown in FIG. 4, the two rows of approximately parallel stitches include a first row of stitches 420 and a second row of stitches 422. In this embodiment, second row of stitches 422 is disposed closer to first end 404 of braid body 104 along connection area 200 than first row of stitches 420. That is, second row of stitches 422 is located more inward towards the throat area of braided upper 102 where first end 402 of component 106 abuts with first end 404 of braid body 104 along connection area 200.

In an example embodiment, connecting stitch 418, including one or more of first row of stitches 420 and/or second row of stitches 422, passes through reinforcement element 400 and the at least one braided layer of braid body 104 such that a portion of connecting stitch 418 extends through braid body 104 to outer surface 414, forming a plurality of loops on outer surface 414 where the stitches repeatedly extend into and out of reinforcement element 400 and braid body 104. In some embodiments, connecting stitch 418, including one or more loops of first row of stitches 420 and/or second row of stitches 422, disposed on outer surface 414 of braid body 104 may be covered by seam cover element 300.

In one embodiment, connecting stitch 418 may be a lockstitch. In other embodiments, connecting stitch 418 may be a different type of stitch, such as a chainstitch, coverstitch, or other suitable type of stitch to join reinforcement element 400 to braid body 104. Additionally, while in an example embodiment, connecting stitch 418 includes two rows of approximately parallel stitches, in other embodiments, additional stitches may be used to secure reinforcement element 400 to braid body 104.

Figure 5:
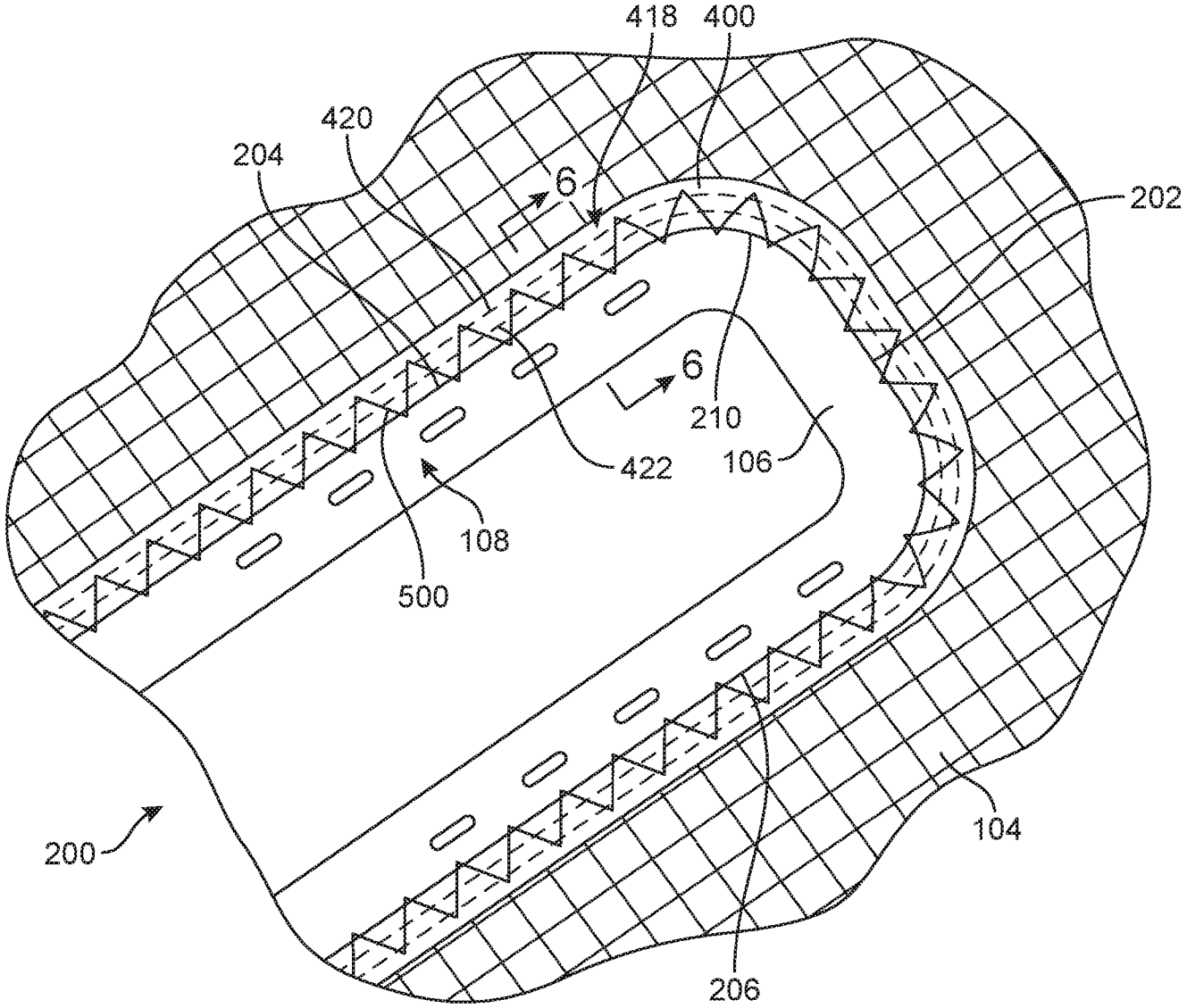
FIG. 5 is an enlarged view of a backside of the connection area of the braided upper.

FIG. 5 is an enlarged view of a backside of connection area 200 of braided upper 102 of article of footwear 100 (e.g., the backside of braided upper 102 is associated with an interior of article of footwear 100). In an example embodiment, component 106 may be attached or joined with braid body 104 by stitching component 106 to braid body 104 at connection area 200 using a zigzag stitch 500. According to the techniques of the present embodiments, outer edge 210 of component 106 is joined to braid body 104 along connection area 200 using zigzag stitch 500 that attaches component 106 to braid body 104 along connection area 200, including at forward edge 202, lateral instep edge 204, and medial instep edge 206 of braid body 104 in the throat area of braided upper 102.

In an example embodiment, zigzag stitch 500 passes through component 106 at one end and passes through both reinforcement element 400 and a portion of braid body 104 disposed beneath reinforcement element 400 at the other end to secure component 106 to braid body 104. As shown in FIG. 5, zigzag stitch 500 extends beyond connecting stitch 418, including one or more of first row of stitches 420 and/or second row of stitches 422, that joins reinforcement element 400 to braid body 104. With this arrangement, a loop of at least one row of connecting stitch 418 (e.g., first row of stitches 420 and/or second row of stitches 422) is caught by zigzag stitch 500.

Because braid body 104 includes at least one braided layer formed by a plurality of strands that are intertwined and twisted together, conventional stitching techniques used to join components to braid body 104 can result in several missed stitches, thus causing the attachment of the components to braid body 104 to fail or unravel. Conventional solutions involve providing overlapping layers or portions of braided layers on the braided upper so that additional components may be stitched to these overlapping layers or portions. However, these conventional solutions may result in ridges or thicker areas on the braided upper that can cause discomfort and unpleasant feelings to a foot of a wearer.

The techniques of the present embodiments provide a mechanism for stitching a component to the braided upper without overlapping the braided layers or portions. For example, returning to FIG. 6, by using zigzag stitch 500 to secure component 106 to braid body 104 such that zigzag stitch 500 extends beyond at least one row of connecting stitch 418 (e.g., first row of stitches 420 and/or second row of stitches 422) that joins reinforcement element 400 to braid body 104, component 106 may be securely attached to braid body 104. Additionally, this arrangement allows outer edge 210 of component 106 to abut, rather than overlap, edges of braid body 104 along connection area 200 when joined by zigzag stitch 500. For example, as shown in FIG. 6, outer edge 210 of component 106 abuts forward edge 202, lateral instep edge 204, and medial instep edge 206 of braid body 104 in the throat area of braided upper 102 along connection area 200.

Figure 6:
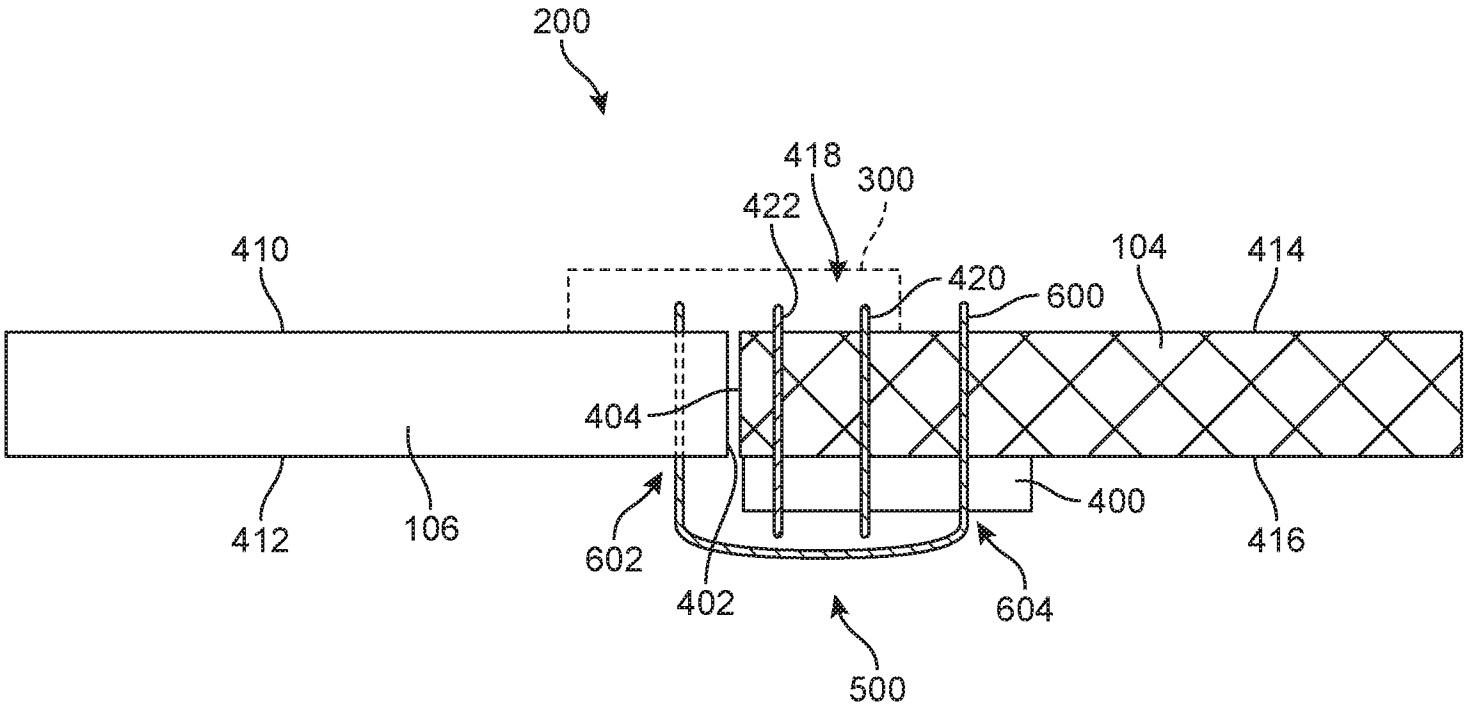
FIG. 6 is a cross-sectional view of the braided upper from FIG. 5 taken along line 6-6.

FIG. 6 is a cross-sectional view of braided upper 102 from FIG. 5 taken along line 6-6. In this embodiment, zigzag stitch 500 connecting component 106 to braid body 104 is shown in detail. In an example embodiment, zigzag stitch 500 includes a thread 600 that passes through component 106 at a first location 602 and passes through reinforcement element 400 and braid body 104 at a second location 604. In one embodiment, second location 604 extends beyond connecting stitch 418 joining reinforcement element 400 to braid body 104. That is, second location 604 where thread 600 of zigzag stitch 500 passes through both reinforcement element 400 and braid body 104 is outward of at least one row of connecting stitch 418 (e.g., first row of stitches 420 and/or second row of stitches 422) that joins reinforcement element 400 to braid body 104.

For example, in this embodiment, thread 600 of zigzag stitch 500 passes through component 106 at first location 602 disposed on inner surface 412 of component 106 adjacent to first end 402 of component 106 that abuts first end 404 of braid body 104 along connection area 200. Thread 600 extends over the seam between the abutting portions of component 106 and braid body 104 (e.g., first end 402 and first end 404) at connection area 200 and passes through reinforcement element 400 and braid body 104 at second location 604 on the backside of braided upper 102. In this embodiment, thread 600 of zigzag stitch 500 extends over first row of stitches 420 and second row of stitches 422, thereby catching a loop of at least one row of connecting stitch 418 used to join reinforcement element 400 to inner surface 416 of braid body 104. A connecting stitch (e.g., connecting stitch 418) caught by thread 600 of zigzag stitch 500 may be referred to herein as a reinforced stitch.

As shown in FIG. 6, second location 604 is outward of both first row of stitches 420 and second row of stitches 422. In other embodiments, second location 604 may be outward of only one row (e.g., second row of stitches 422). By catching a loop of at least one row of connecting stitch 418, zigzag stitch 500 may securely join component 106 to braid body 104 without unraveling. Additionally, by providing at least two rows for connecting stitch 418, the probability of catching a loop of one of the rows when stitching zigzag stitch 500 to join component 106 to braid body 104 increases. That is, by providing two approximately parallel rows of stitches for connecting stitch 418 to join reinforcement element 400 to braid body 104, zigzag stitch 500 has a greater chance of catching a loop of a stitch from one row of stitches of connecting stitch 418 beneath thread 600.

With this arrangement, the method of joining component 106 to braid body 104 may be more efficient. Personnel stitching together component 106 and braid body 104 with zigzag stitch 500 are more likely to catch a loop of a stitch from at least one row of stitches of connecting stitch 418 (e.g., first row of stitches 420 and/or second row of stitches 422) beneath thread 600 according to the techniques described herein.

In addition, in some embodiments, upon completion of stitching component 106 and braid body 104 together using zigzag stitch 500, seam cover element 300 may be provided on the exterior of braided upper 102 to cover the seam between the abutting portions of component 106 and braid body 104 along connection area 200.

Figure 7:
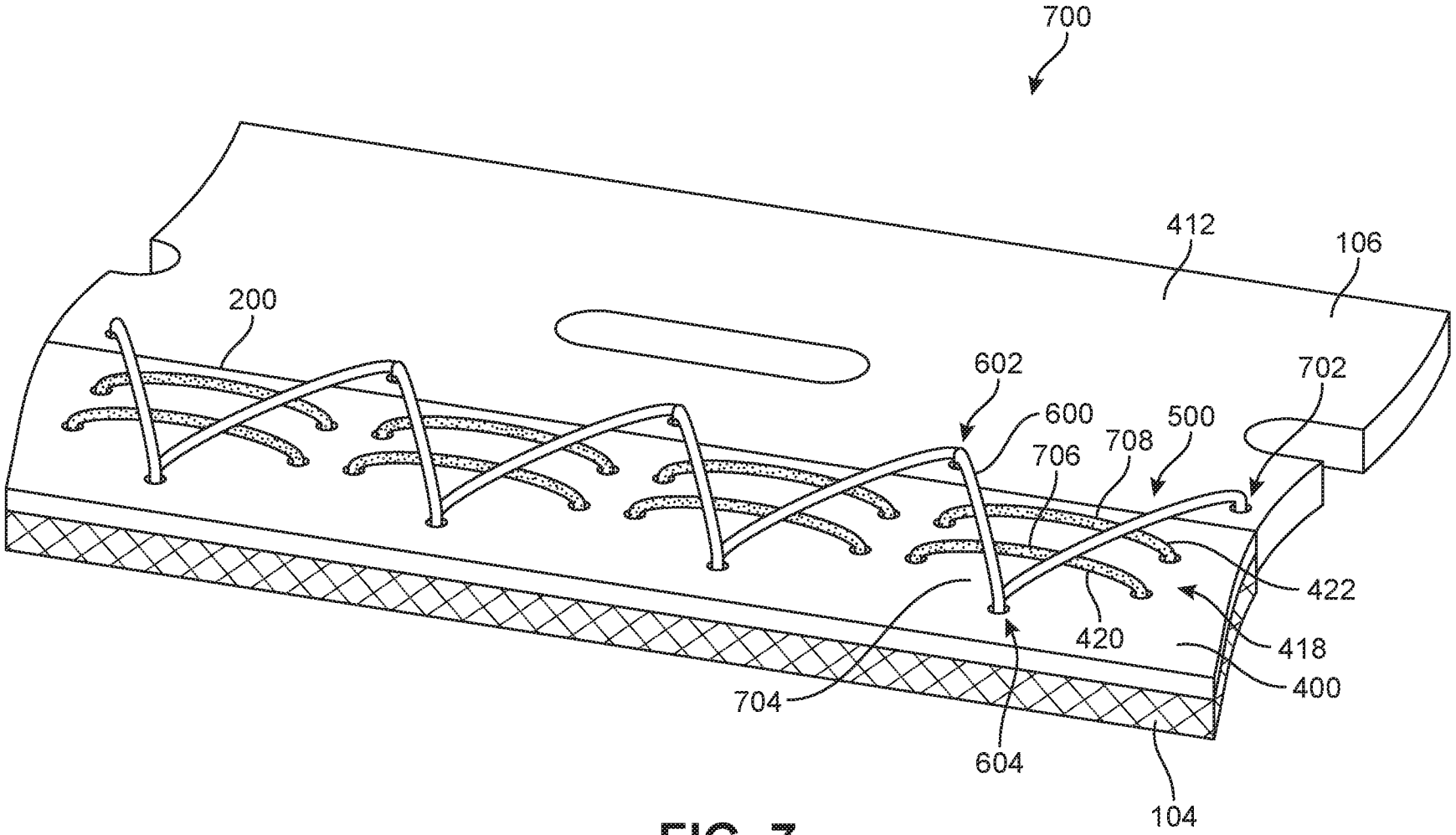
FIG. 7 is an enlarged schematic view of an example embodiment of a reinforced stich.

FIG. 7 is an enlarged schematic view of an example embodiment of a reinforced stich 700. In this embodiment, a backside of connection area 200 of braided upper 102 of article of footwear 100 is shown with a plurality of reinforced stitches 700. As shown in FIG. 7, reinforced stitch 700 includes a loop of at least one row of connecting stitch 418 (e.g., first row of stitches 420 and/or second row of stitches 422) that is caught beneath thread 600 of zigzag stitch 500.

For example, in this embodiment, thread 600 of zigzag stitch 500 passes through component 106 at first location 602 disposed on inner surface 412 of component 106 that abuts braid body 104 along connection area 200. Thread 600 extends over the seam between the abutting portions of component 106 and braid body 104 at connection area 200 and passes through both reinforcement element 400 and braid body 104 at second location 604 on the backside of braided upper 102 that is outward of at least one row of stitches of connecting stitch 418. In this embodiment, thread 600 of zigzag stitch 500 extends over both first row of stitches 420 and second row of stitches 422, thereby catching at least one loop of connecting stitch 418 used to join reinforcement element 400 to inner surface 416 of braid body 104. Additionally, thread 600 of zigzag stitch 500 extends back from second location 604 over first row of stitches 420 and second row of stitches 422 of connecting stitch 418 and passes through inner surface 412 of component 106 at a third location 702 adjacent to connection area 200.

In an example embodiment, at least one loop of the two rows of approximately parallel stitches is disposed between thread 600 of zigzag stitch 500 and an outer surface 704 of reinforcement element 400. For example, as shown in FIG. 7, a first loop 706 of first row of stitches 420 is caught by zigzag stitch 500 such that first loop 706 is disposed between thread 600 and outer surface 704 of reinforcement element 400. Additionally, in this embodiment, a second loop 708 of second row of stitches 422) is also caught by zigzag stitch 500 such that second loop 708 is disposed between thread 600 and outer surface 704 of reinforcement element 400. With this arrangement, plurality of reinforced stitches 700 may be stitched along connection area 200 to join component 106 to braid body 104.

Figure 8:
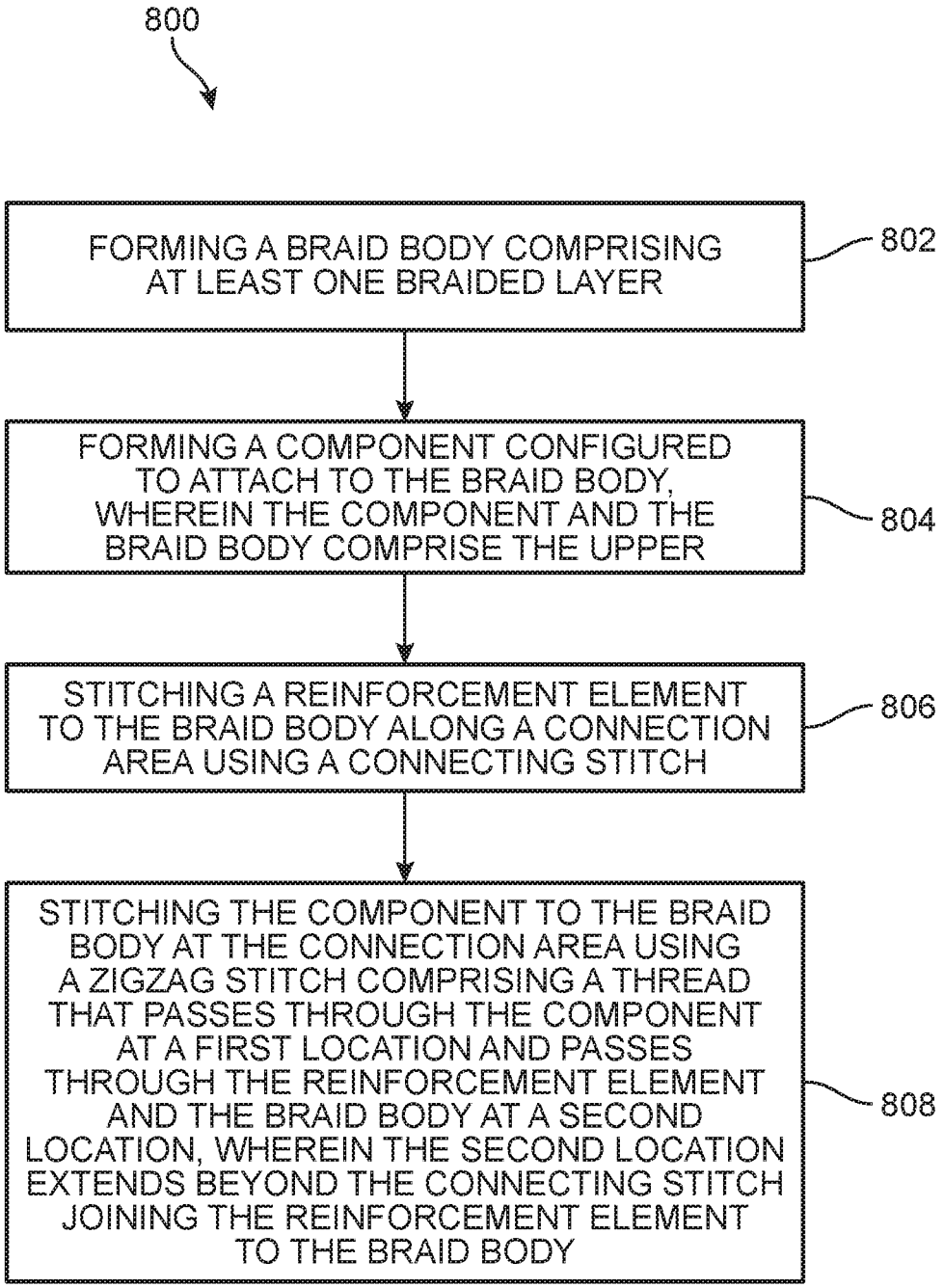
FIG. 8 is a flowchart of an example embodiment of a method of providing a reinforced stitch on a braided article of footwear.

FIG. 8 is a flowchart of an example embodiment of a method 800 of providing a reinforced stitch on a braided article of footwear. In an example embodiment, method 800 may be used to form braided upper 102 that includes braid body 104 and at least one component 106 that is formed separately to assembly article of footwear 100, described above. In this embodiment, method 800 begins at an operation 802. At operation 802, a braid body comprising at least one braided layer is formed. For example, as described above, braid body 104 including at least one braided layer may be formed using a braiding machine.

Next, method 800 includes an operation 804. At operation 804, a component configured to attach to the braid body is formed. The component is formed separately from the braid body and, together, the component and the braid body comprise the braided upper for the braided article of footwear. For example, component 106, including lace eyelet element 108 and heel cushioning element 110, are configured to attach to braid body 104 to form braided upper 102 for article of footwear 100.

Method 800 also includes an operation 806. At operation 806, a reinforcement element is stitched to the braid body along a connection area using a connecting stitch. For example, connection area 200 is a portion of the braided layer of braid body 104 at which component 106 will be attached to braid body 104. As shown in FIGS. 4-7, reinforcement element 400 is joined to braid body 104 using connecting stitch 418. In one embodiment, connecting stitch 418 includes two rows of approximately parallel stitches (e.g., first row of stitches 420 and second row of stitches 422).

Method 800 also includes an operation 808. At operation 808, the component is stitched to the braid body at the connection area using a zigzag stitch. The zigzag stitch comprises a thread that passes through the component at a first location and passes through the reinforcement element and the braid body at a second location. The second location extends beyond the connecting stitch joining the reinforcement element to the braid body. With this arrangement, operation 808 may be repeated along the connection area to form a plurality of reinforced stitches that securely attach the component to the braid body.

For example, as described above with reference to FIG. 7, thread 600 of zigzag stitch 500 passes through component 106 at first location 602 disposed on inner surface 412 of component 106 that abuts braid body 104 along connection area 200. Thread 600 extends over the seam between the abutting portions of component 106 and braid body 104 at connection area 200 and passes through both reinforcement element 400 and braid body 104 at second location 604 on the backside of braided upper 102 that is outward of at least one row of stitches of connecting stitch 418. In this example of operation 808, thread 600 of zigzag stitch 500 extends over both first row of stitches 420 and second row of stitches 422, thereby catching at least one loop of connecting stitch 418 used to join reinforcement element 400 to inner surface 416 of braid body 104.

Method 800 may be repeated for each component to be joined or attached to the braid body to form the braided upper. In addition, in some embodiments, method 800 may include additional finishing and manufacturing operations not explicitly described herein that are conventional for assembling an article of footwear. For example, upon completion of method 800 to form braided upper 102 in accordance with the techniques described herein, sole assembly 116 may be attached or secured to braided upper 102 to assemble braided article of footwear 100.

It should be understood that in some cases, stitches may include backing threads or similar components not shown in the Figures above for purposes of illustration.

While various embodiments have been described, the description is intended to be exemplary, rather than limiting, and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

The invention claimed is:

1. An article of footwear, comprising:

an upper including a braid body and at least one component, wherein the braid body comprises at least one braided layer;

a connection area where edges of the braid body and the component are abutting;

a reinforcement element attached to only an inner surface of the braid body along the connection area adjacent to an inner surface of the component, such that the reinforcement element covers the inner surface of the braid body without covering the inner surface of the component;

a connecting stitch extending through the reinforcement element and the at least one braided layer to an outer surface of the braid body opposite the inner surface to attach the reinforcement element to the inner surface of the braid body; and a zigzag stitch comprising a thread that passes through the inner surface of only the component at a first location and passes through both of the reinforcement element and the braid body at a second location to attach the component to the braid body at the connection area, wherein the second location is in a direction from the component that is laterally beyond the connecting stitch attaching the reinforcement element to the inner surface of the braid body;

wherein the thread of the zigzag stitch extends over at least one loop of the connecting stitch attaching the reinforcement element to the inner surface of the braid body; and wherein the edges of the braid body and the component are abutting along the connection area such that the braid body and the component are arranged edge to edge.

2. The article of footwear according to claim 1, further comprising a sole assembly.

3. The article of footwear according to claim 1, wherein the connecting stitch comprises two rows of approximately parallel stitches along the connection area.

4. The article of footwear according to claim 3, wherein at least one loop of the two rows of approximately parallel stitches is disposed between the thread of the zigzag stitch and an outer surface of the reinforcement element.

5. The article of footwear according to claim 1, wherein an outer edge of the component abuts the braid body along each of a forward edge, a lateral instep edge, and a medial instep edge in a throat area of the upper.

6. The article of footwear according to claim 1, wherein the component is a lace eyelet element; and wherein the connection area includes a throat area of the braid body.

7. The article of footwear according to claim 1, wherein the component is a heel cushioning element; and wherein the connection area includes a heel area of the braid body.

8. The article of footwear according to claim 1, further comprising a seam cover element disposed over a portion of the braid body and a portion of the component along the connection area.

9. An article of footwear, comprising:

a braided upper including a throat area and a heel area;

a component including a lace eyelet element and a heel cushioning element;

a connection area where edges of the braided upper and the component are abutting, wherein the connection area includes the throat area and the heel area;

a reinforcement element attached to only an inner surface of the braided upper along the connection area adjacent to an inner surface of the component, such that the reinforcement element covers the inner surface of braided upper without covering the inner surface of the component;

two rows of approximately parallel stitches passing through the reinforcement element and the braided upper to an outer surface of the braided upper opposite the inner surface to attach the reinforcement element to the inner surface of the braided upper; and a zigzag stitch comprising a thread that passes through the inner surface of only the component at a first location and passes through both of the reinforcement element and the braided upper at a second location to attach the component to the braided upper at the connection area, wherein the second location is in a direction from the component that is laterally beyond the two rows of approximately parallel stitches attaching the reinforcement element to the inner surface of the braided upper;

wherein the thread of the zigzag stitch extends over at least one loop of the two rows of approximately parallel stitches attaching the reinforcement element to the inner surface of the braided upper; and wherein the edges of the braided upper and the component are abutting along the connection area such that the braided upper and the component are arranged edge to edge.

10. The article of footwear according to claim 9, wherein at least one loop of the two rows of approximately parallel stitches is disposed between the thread of the zigzag stitch and an outer surface of the reinforcement element.

11. The article of footwear according to claim 9, wherein an outer edge of the component abuts the braided upper along each of a forward edge, a lateral instep edge, and a medial instep edge in the throat area of the braided upper.

12. The article of footwear according to claim 9, further comprising a seam cover element disposed over a portion of the braided upper and a portion of the component along the connection area.

13. A method of making an upper for an article of footwear, the method comprising:

forming a braid body comprising at least one braided layer;

forming a component configured to attach to the braid body, wherein the component and the braid body together form at least a portion of the upper;

stitching a reinforcement element to only an inner surface of the braid body using a connecting stitch along a connection area where edges of the braid body and the component are abutting, wherein the reinforcement element is adjacent to an inner surface of the component and covers the inner surface of the braid body without covering the inner surface of the component;

the connecting stitch extending through the reinforcement element and the at least one braided layer to an outer surface of the braid body opposite the inner surface to attach the reinforcement element to the inner surface of the braid body;

stitching the component to the braid body at the connection area using a zigzag stitch comprising a thread that passes through the inner surface of only the component at a first location and passes through both of the reinforcement element and the braid body at a second location to attach the component to the braid body at the connection area, wherein the second location is in a direction from the component that is laterally beyond the connecting stitch joining the reinforcement element to the inner surface of the braid body, wherein the thread of the zigzag stitch extends over at least one loop of the connecting stitch attaching the reinforcement element to the inner surface of the braid body; and wherein edges of the braid body and the component are abutting along the connection area such that the braid body and the component are arranged edge to edge.

14. The method according to claim 13, wherein the connecting stitch comprises two rows of approximately parallel stitches along the connection area.

15. The method according to claim 14, wherein at least one loop of the two rows of approximately parallel stitches is disposed between the thread of the zigzag stitch and an outer surface of the reinforcement element.

16. The method according to claim 13, wherein an outer edge of the component abuts the braid body along each of a forward edge, a lateral instep edge, and a medial instep edge in a throat area of the upper.

17. The method according to claim 13, wherein the connecting stitch is a lockstitch.

18. The method according to claim 13, further comprising attaching the upper to a sole assembly to form the article of footwear.

19. The method according to claim 13, wherein the component is a lace eyelet element; and wherein the connection area includes a throat area of the braid body.

20. The method according to claim 13, wherein the component is a heel cushioning element; and wherein the connection area includes a heel area of the braid body.

* * * * *